United States Patent [19]

Gill et al.

[11] 4,053,017

[45] Oct. 11, 1977

[54] CROSS SLOPE CONTACT SYSTEM FOR SURFACE FINISHING MACHINES

[75] Inventors: Raymond E. Gill, Clearwater, Fla.; Floyd McMahon, Peoria, Ill.

[73] Assignee: Westinghouse Air Brake Company, Pittsburgh, Pa.

[21] Appl. No.: 629,897

[22] Filed: Nov. 7, 1975

[51] Int. Cl.[2] ..... E02F 3/76

[52] U.S. Cl. ..... 172/4.5; 33/264; 172/430

[58] Field of Search ..... 172/4.5, 430, 480, 792, 172/791, 307; 33/264

[56] References Cited

U.S. PATENT DOCUMENTS

| | | | |
|---|---|---|---|
| 1,847,728 | 3/1932 | Schmid | 172/430 |
| 1,993,282 | 3/1935 | Porter | 172/430 X |
| 3,328,905 | 7/1967 | Page et al. | 172/430 X |
| 3,776,315 | 12/1973 | Gill et al. | 172/4.5 |

*Primary Examiner*—George J. Marlo
*Attorney, Agent, or Firm*—Leydig, Voit, Osann, Mayer & Holt, Ltd.

[57] ABSTRACT

Cross slope sensing apparatus for directly and accurately measuring the cross slope of a surface finishing machine cutting blade regardless of the depth or angle of the cut, or the looseness of the attachment of the blade to the machine. The apparatus includes a sensor support table that rests on the upper edge of the cutting blade and linkage for maintaining the longitudinal axis of the table parallel to the longitudinal axis of the machine during selective positioning of the cutting blade. Since the table rides on the upper edge of the cutting blade while remaining forwardly oriented, the inclination of the table reflects the true cross slope of the blade and is directly measured and controlled by a sensor positioned on the table.

10 Claims, 7 Drawing Figures

CROSS SLOPE CONTACT SYSTEM FOR SURFACE FINISHING MACHINES

DESCRIPTION OF THE INVENTION

The present invention relates generally to surface finishing equipment such as graders and the like, and more particularly, to systems for automatically measuring and controlling the cross slope of the machine cutting tool.

It has long been common practice to support and pull the cutting blade of large surface finishing machines by a drawbar attached to the machine at a forward pivot point, normally referred to as the drawbar draft ball. Such a pivot and support point permits multi-directional movement of the blade to desired depths and cross slope angles and serves as the vertex for such movements. To further facilitate the desired manipulation of the cutting blade for different cutting conditions, the drawbars of most graders carry the cutting blade on a turntable or circle that permits rotation of the blade about a vertical axis.

Because the cutting blade can be selectively positioned in various planes and is not maintained perpendicular to the line of travel of the machine, the measurement and control of the cross slope angle of the cutting blade has heretofore caused problems. For example, some surface finishing machines mount cross slope sensing apparatus on the main frame of the machine and sense the slope of the cut as the rear wheels of the grader pass over the finished surface. Many inaccuracies result in such systems due to the inherent looseness of the mechanism securing the cutting blade to the frame and the differences in ground compaction or wheel penetration into the finished surface. The cutting blade also must be kept full so as not to leave depressions that the rear wheels may ride into.

Other cross slope sensing devices have included sensors that are mounted on the turntable or circle supporting the blade. Since these devices do not sense the true cut angle when the delivery angle of the blade is changed or when the blade is laterally moved about the universal drawbar ball, an average corrected cross slope must be computed from the signals of several sensors. Such designs are expensive, costly to incorporate into the cutting machine, and often do not sense or control the cutting blade angle with good accuracy.

It is the object of the present invention to provide a system for more directly and accurately sensing cutting edge cross slope angles of surface finishing machines.

Another object is to provide a cross slope sensing system as characterized above that is unaffected by loose joints between the drawbar and machine frame or by the defection of tires of the machine.

A further object is to provide a cross slope sensing and control system of the above kind which is adapted to sense crossgrade angles directly at the cutting blade regardless of the depth or angle of the cut, or the attitude of the machine.

Still another object is to provide such a crossgrade sensing and control system which is economical to produce and may be readily incorporated into the machine.

Other objects and advantages of the invention will become apparent from the following detailed description and upon reference to the drawings, in which.

Figure 1:
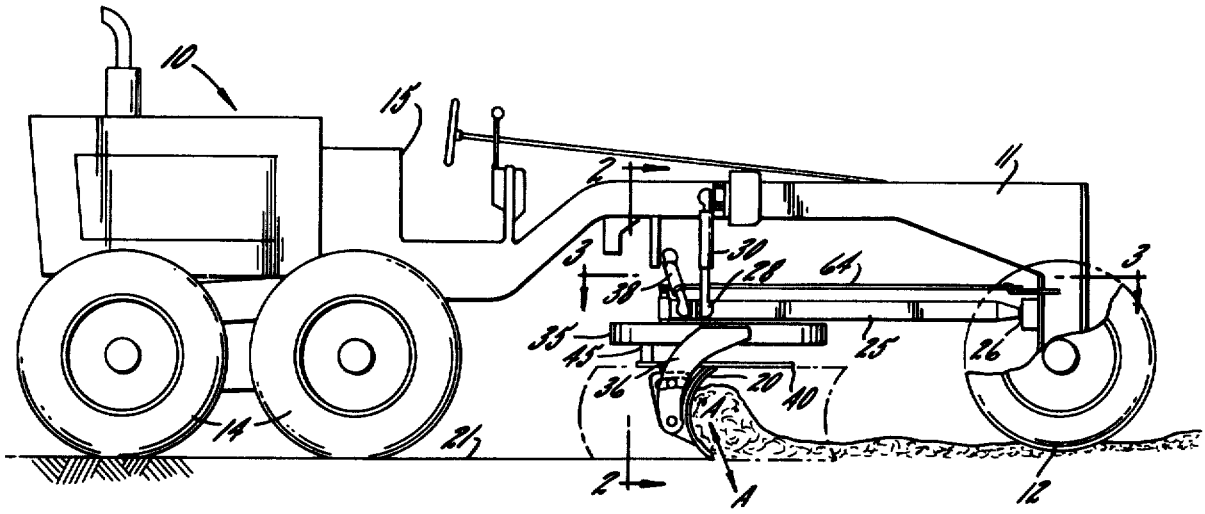
FIG. 1 is a partially diagrammatic side elevational view of the grader with a cutting blade cross slope sensing system of the present invention.

While the invention is susceptible of various modifications and alternative constructions, a certain illustrative embodiment thereof has been shown in the drawings and will be described below in detail. It should be understood, however, that there is no intention to limit the invention to the specific form disclosed, but, on the contrary, the intention is to cover all modifications, alternative constructions, and equivalents falling within the spirit and scope of the invention.

Referring more particularly to FIG. 1 of the drawings, there is shown a surface finishing machine 10, such as a grader or the like, that includes a frame 11 supported by forward wheels 12 and a double set of rear wheels 14. The machine may be driven from a cab 15, and it has a selectively positionable transverse cutting blade 20 adapted to clear a surface 21 to the desired grade as the machine moves in a forward direction. The cutting blade 20 is carried at the end of a drawbar 25 supported by the machine frame 11 at three points of suspension, including a forward universal drawbar ball 26 attached directly to the frame 11 and two rearward points 28, 29 at opposite sides of the drawbar which in this case are suspended from the frame 11 by hydraulic rams 30, 31. Mounted on the underside of the drawbar 25 is a conventional circle 35 having fixed thereto a pair of diametrically opposed accurate support legs 36 that are connected to the rear side of the cutting blade 20.

Figure 2:
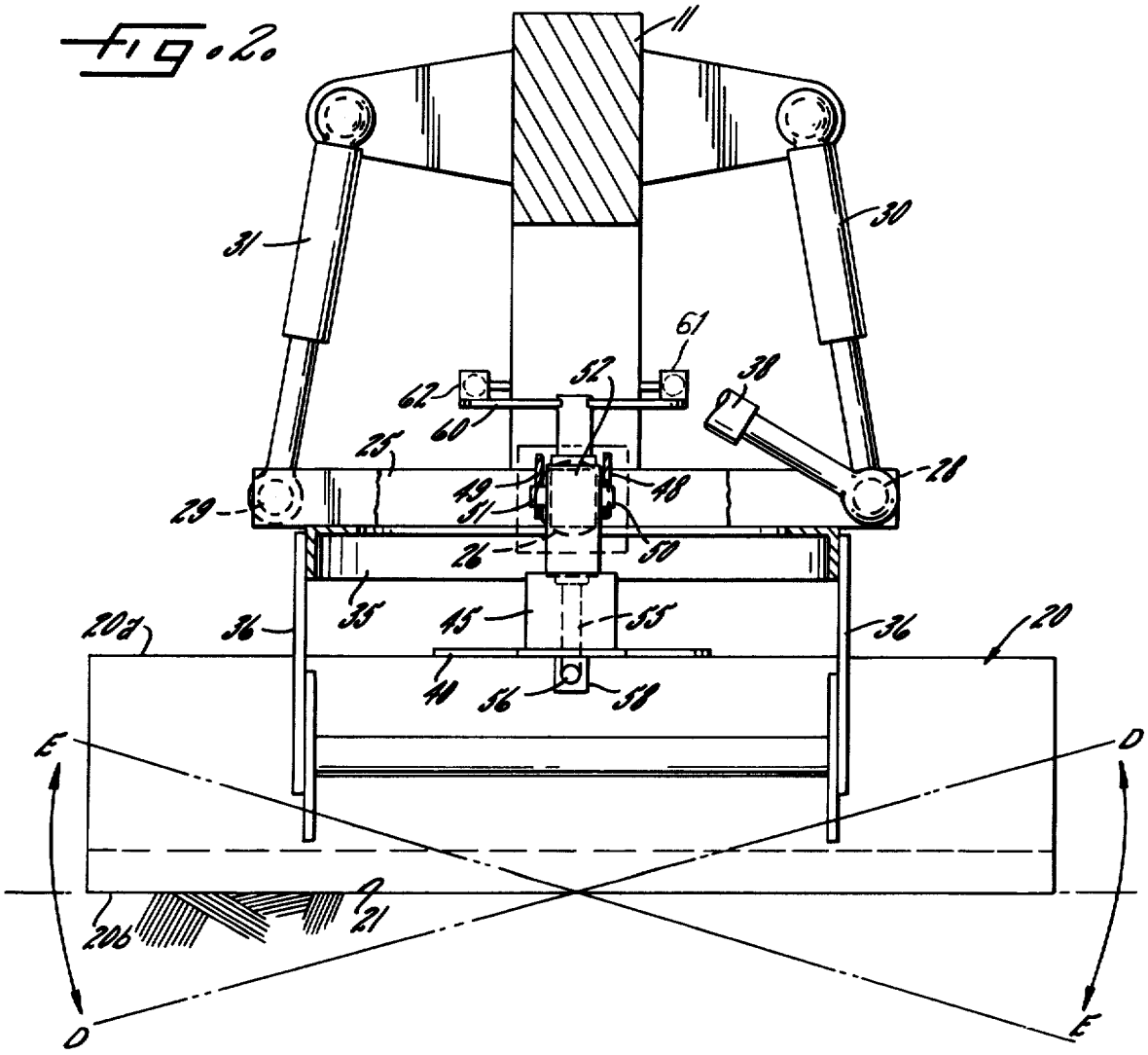
FIG. 2 is an enlarged fragmentary section taken in the plane of line 2—2 in FIG. 1.
Figure 3:
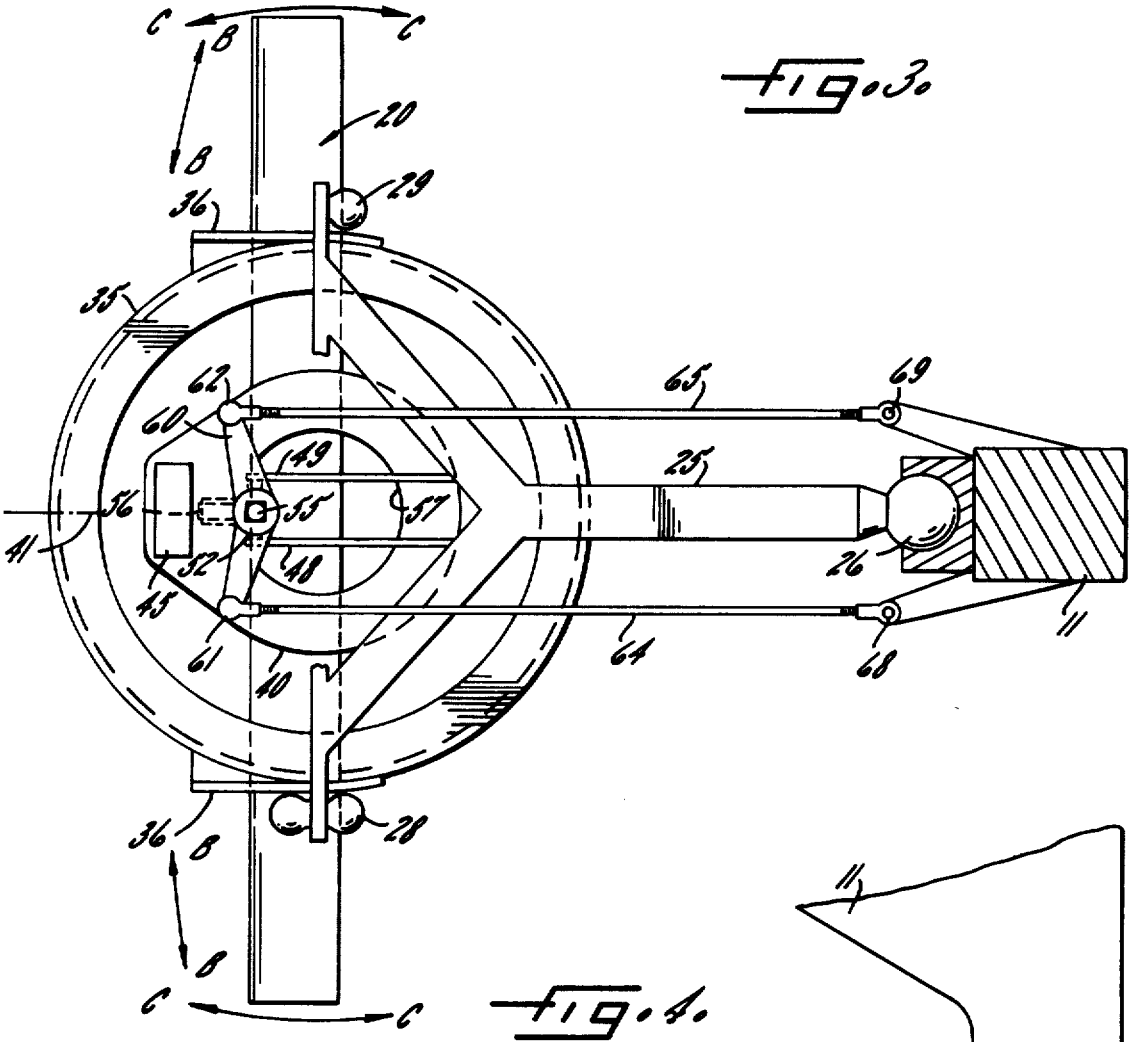
FIG. 3 is an enlarged fragmentary section taken in the plane of line 3—3 in FIG. 1.

Typical movements of the cutting blade 20 are depicted in FIGS. 1-3. By actuation of the hydraulic rams 30, 31, both the depth and cross slope of the cutting blade 20 can be adjusted. The cutting blade depth adjustment is made by raising and lowering the cutting blade along line A—A, as shown in FIG. 1, while adjustment of the blade slope for establishing the desired crossgrade is depicted by letters D—D and E—E in FIG. 2. The delivery angle of the cutting blade may be varied through pivotable movement of the circle 35 and the blade supported thereon, as indicated by line C—C in FIG. 3, which may be effected by known means. The blade 20 also may be laterally shifted about the drawbar pivot 26 along line B—B, as viewed in FIG. 3, to clear obstacles while cutting. In the illustrated embodiment, a hydraulic cylinder 38 coupled between the machine frame 11 and circle support point 28 effects such lateral movement. It will be understood by one skilled in the art that any of various known manual, hydraulic, or electrical means may be utilized for accomplishing such movements of the cutting blade.

In accordance with the invention, means are provided for directly and accurately sensing and controlling the cross slope of the cutting blade notwithstanding loose joints between the drawbar and frame or deflections that might occur in the tires of the machine as it travels over the finished surface. To this end, a cross slope sensor support in the form of a table 40 is positioned on a top edge 20a of the cutting blade 20 in centered relation below the circle 35 and is maintained parallel to the cutting blade and aligned with the longitudinal axis of the machine regardless of the inclination of the drawbar 25 or the delivery and pitch angles of the cutting blade 20. It can be seen that since top edge 20a of the cutting blade 20 is parallel with a bottom cutting edge 20b the support table 40 similarly parallels the cutting edge. The support table 40 is positioned on the cutting blade 20 with its longitudinal axis 41 in a forwardly oriented direction parallel to the longitudinal axis of the machine. For sensing the angle of the support table relative to the horizontal, a slope sensor device 45 is mounted in upstanding relation at a rearward end of the support table 40.

For supporting the table 40 on the top edge 20a of the cutting blade 20, the drawbar 25 has a pair of depending bearing supports 48, 49 that receive respective diametrically opposed, horizontally aligned pins 50, 51 of a trunnion bearing 52. The trunnion 52 in turn receives a vertical pivot pin 55 for relative rotational and axial movement with the horizontal pins 50, 51 of the trunnion being disposed at 90° angles to the vertical pin 55 and to the line of machine travel. The pin 55 in this case has a square shaped cross section that fits within a correspondingly shaped aperture of a sleeve 53. The pin 55 thereby rotatable with the sleeve 53 relative to the trunnion 52 while being vertically movable with respect to both the sleeve 53 and trunnion 52. The illustrated sleeve 53 has a radial flange 53a positionable on the upper end of the trunnion 52. A pin 56 extends perpendicularly from the lower end of the pin 55 in the direction of machine travel and supports the table 40 for pivotable movement about its longitudinal axis 41. For this purpose a bearing 58 is fixed to the underside of the table 40, and the table is formed with a suitable aperture 57 through which the vertical pivot pin 55 extends.

In order to maintain the longitudinal axis of the support table 40 in line with the forward direction machine travel, a V-shaped lever 60 is fixed at its apex to the upper end of the vertical pivot pin sleeve 53 and ball joint connectors 61, 62 are provided at the respective ends of the two arms of the lever 60. The ball joints 61, 62 are connected to links 64, 65 which in turn are coupled to the machine frame 11 through ball joints 68, 69. Referring to FIG. 3, it will be seen that the pivot points 68, 69 are selectively located in equal distance relation to the drawbar pivot ball 26 and the pivot points 61, 62 are similarly located with respect to the vertical pivot pin 55 so that the pivot points 61, 62, 68, 69 form a parallelogram. As a result, if the drawbar is shifted laterally along line B—B indicated in FIG. 3, the longitudinal axis 41 of the support table 40 will remain in alignment with the line of forward travel of the machine. The links 64, 65 preferably have threaded connections with the ball joints 61, 62, 68, 69 so as to permit selective adjustment of their lengths to insure the establishment of the perfect parallelogram during assembly of the slope sensing apparatus on the machine.

Figure 4:
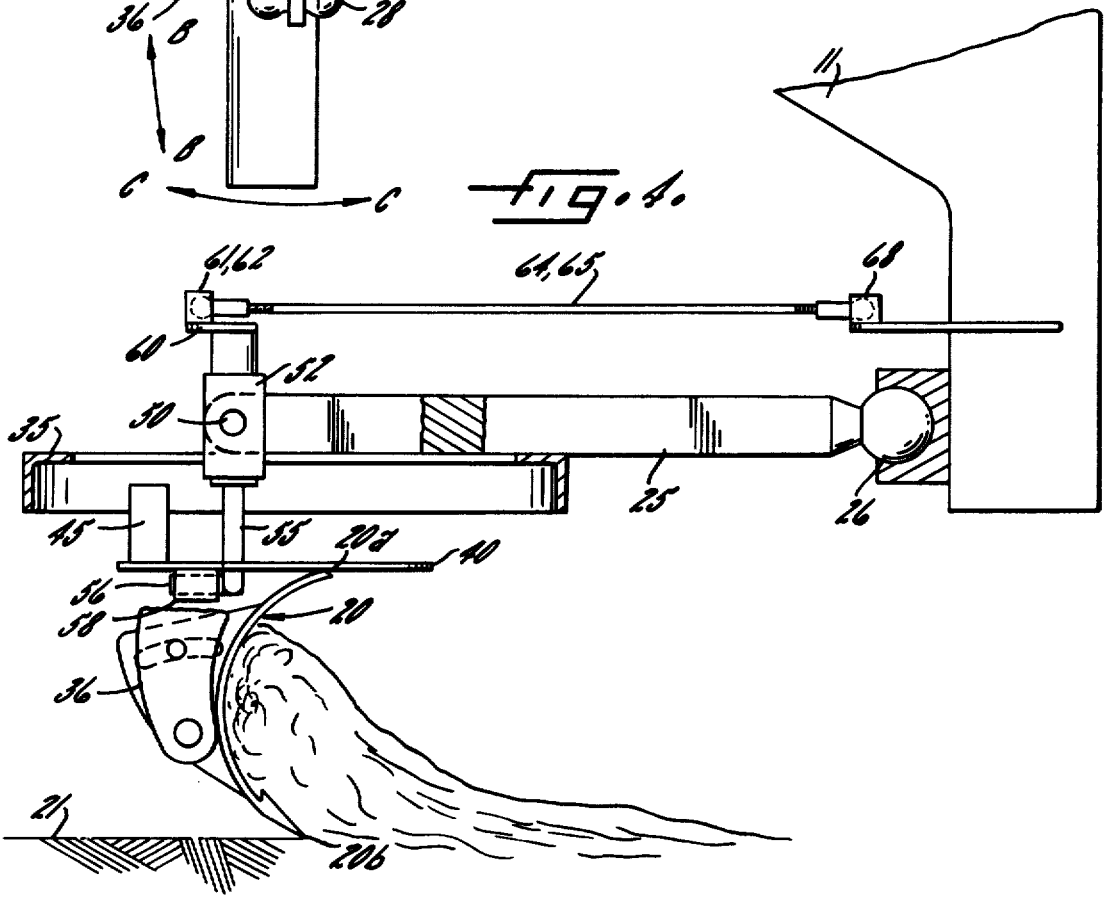
FIG. 4 is a side elevational view of the cutting blade, drawbar support and sensing apparatus included in the illustrated machine.
Figure 5:
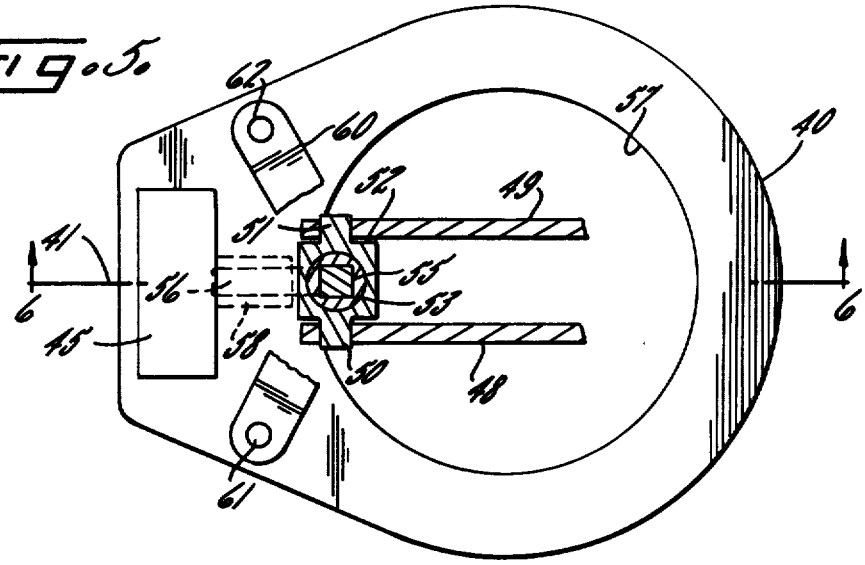
FIG. 5 is a top view of the sensing apparatus shown in FIG. 4.
Figure 6:
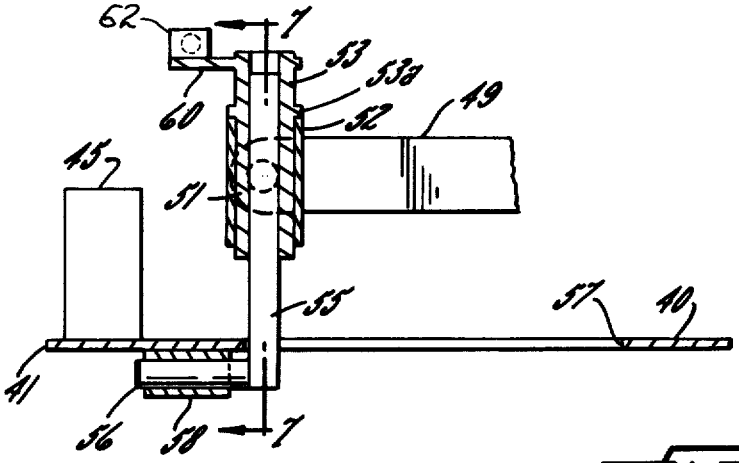
FIG. 6 is a vertical section taken in the plane of line 6—6 in FIG. 5.
Figure 7:
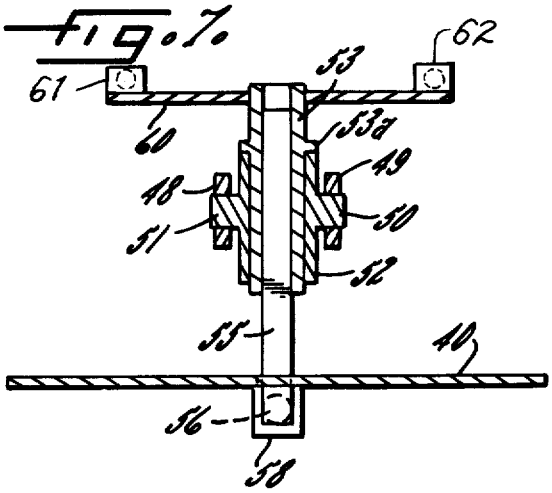
FIG. 7 is a vertical section taken in the plane of line 7—7 in FIG. 6.

To maintain the table axis 41 in a horizontal condition during raising and lowering of the cutting blade 20 along line A—A in FIG. 1, pivot points 68, 69 when viewed in a vertical plane, such as FIG. 4, form a single point in selected relation to the drawbar pivot 26 and pivot points 61, 62 form a single point located in similar relation to pivot points 50, 51. Thus, when viewed in a vertical plane, pivot points 61, 62 and 50, 51 and 68, 69 and 26 define a second parallelogram. In this case, the rods 64, 65 form one long side of the parallelogram with the drawbar 25 forming the opposite long side.

While the two parallelograms described above function to maintain the longitudinal table axis 41 in a horizontal condition and parallel to the longitudinal machine axis, the pivotal connection of the support table 40 to the horizontal pivot pin 56 allows the table 40 to always rest on the top edge 20a of the cutting blade so as to be parallel to the cutting edge 20b and the surface generated therefrom even though the slope of the blade 20 represented by lines D—D and E—E in FIG. 2 is at an angle to the horizontal and the delivery angle, represented by line C—C in FIG. 3, is not perpendicular to the line of forward travel of the machine. It will be seen that when the delivery angle is changed the cutting blade 20 will be pivotably moved relative to the table 40 since the longitudinal axis of the table is maintained in a forward direction. Also, the sensor support table 40 will slide up and down on the vertical pivot pin 55 to the extent necessary to insure that the table remains directly on the upper cutting blade edge 20a. The table 40, therefore, remains parallel to the cross slope generated by the blade and provides an accurate platform upon which the slope sensor 45 may be mounted.

The slope sensor 45, which may be of a known pendulum type such as described in detail in applicants' U.S. Pat. No. 3,776,315, is mounted on the table 40 with its axis aligned with the longitudinal axis 41 of the table. As indicated above, since the axis 41 of the support table is maintained in a horizontal, forwardly aligned condition, the slope of the table upon pivoting about the horizontal pin 56 will always be parallel with the true crossgrade generated by the cutting edge 20b. The cross slope generated by the cutting blade, therefore, may be sensed and measured by the sensor 45 directly from the slope of the table. By suitable controls, such as described in the above mentioned patent, the sensing device may be set so that the cross slope of the cutting edge will be automatically maintained at a desired slope.

In assembling the sensor support table 40 in the machine, the cutting blade 20 may be initially positioned so that its cutting edge 20b is exactly level and perpendicular to the longitudinal axis of the machine. With the cutting blade in such level position, the table 40 may be positioned on the upper edge and its support linkage 64, 65 adjusted so that its axis 41 is level with the ground level and in line with the machine. The sensor 45 may then be appropriately set for this zero slope condition.

In operation of the machine, if the operator laterally moves the cutting blade 20 to a cutting position out to one side of the machine through pivotable movement of the drawbar along line C—C, as viewed in FIG. 3, it will be seen that the axis 41 of the sensor support table 40 remains parallel to the line of machine travel by its parallelogram support structure defined by the links 64, 65, the lever 60, and the frame 11. If the delivery angle C—C of the blade 20 is altered by rotation of the blade about the vertical axis of the circle 35, the sensor still retains its true travel position with the blade being rotatably moved relative to the table. In the event the one side of the cutting blade is lowered to a deeper cut, as shown in FIG. 2, the sensor support table 40 will rotate relative to the pivot pin 56 and slide up or down on the pivot pin 55 as necessary, but will always remain at rest on the upper edge 20a of the cutting blade. Since the longitudinal axis of the table, and thus the axis of the sensor, remains in the direction of travel, the angle of the table remains parallel to the true cross slope of the cut and may be measured directly by the sensor.

From the foregoing, it can be seen that the cross slope sensing and control system of the present invention is adapted to sense the true crossgrade angle directly at the cutting blade regardless of the depth or angle of the cut or the attitude of the machine. Because the apparatus is unaffected by loose joints between the drawbar and machine frame or by deflection of the machine tires, it is adapted to sense and control the cross-slope angle with greater accuracy than heretofore possible. The apparatus also is of relatively simple construction and can be readily incorporated into the machine.

We claim as our invention:

1. Apparatus for sensing the cross slope of a surface finishing machine cutting blade which is selectively positionable about a universal drawbar pivot point and which is rotatable with respect to its supportive drawbar about a substantially vertical axis, comprising a support positionable on the upper edge of said cutting blade and having a longitudinal axis parallel to a horizontal longitudinal axis of said machine, means for automatically maintaining said support on the upper edge of said cutting blade with its longitudinal axis in said horizontal condition and parallel to the longitudinal machine axis as the cutting blade is positioned relative to said machine, and sensing means mounted on said support table for sensing the angle of said support with respect to the horizontal.

2. The cross slope sensing apparatus of claim 1 in which said support maintaining means retains said support in rest position on said upper edge while permitting pivotable movement of said cutting blade relative to said support.

3. The cross slope sensing apparatus of claim 2 in which said support maintaining means includes first linkage means having four pivot points that define a parallelogram, said first linkage means parallelogram having two pivot points fixed to said machine frame in equal distant relation to said universal drawbar pivot point, said third and fourth pivot points being at the ends of equal length links extending from said first and second pivot points, and means connecting said first linkage means to said support such that such support axis is maintained parallel to said machine axis during horizontal movement of said blade relative to said machine.

4. The cross slope sensing apparatus of claim 3 in which said support maintaining means includes second linkage means having four pivot points defining a second parallelogram with one pivot point being said universal drawbar pivot point, a second pivot point being fixed to said machine frame in predetermined relation to said drawbar pivot point, and said third and fourth pivot points of said second linkage means being at the ends of equal length links extending from said first and second pivot points, and means connecting said equal length links of said second linkage means to said support such that said support axis is maintained in a horizontal condition during raising and lowering of said cutting blade.

5. The cross slope sensing apparatus of claim 4 in which said support maintaining means includes a vertical pivot pin and a horizontal pivot pin extending from said vertical pivot pin in a direction parallel with the longitudinal machine axis, means on said drawbar for supporting said vertical pivot pin for relative pivotable movement, and said support being pivotably mounted on said horizontal pivot pin along its longitudinal axis.

6. The cross slope sensing apparatus of claim 5 in which said first linkage means includes a lever coupled to said vertical pivot pin and said equal length links of said first linkage means each being pivotably connected at one of their ends to said lever at points equal distance from said vertical pivot pin.

7. The cross slope sensing apparatus of claim 6 in which said vertical pivot pin support means includes a trunnion having a pair of opposed horizontal pivot pins, and means pivotably supporting said trunnion pivot pins on said drawbar.

8. The cross slope sensing apparatus of claim 7 in which said vertical pivot pin is supported within said trunnion for both rotational and axial movement.

9. The cross slope sensing apparatus of claim 7 in which said opposed trunnion pivot pins are perpendicular to said machine longitudinal axis.

10. The cross slope sensing apparatus of claim 7 in which said trunnion pivot pins constitute said third pivot point of said second linkage means parallelogram, and said lever pivot points constitute said fourth pivot point of said second linkage means parallelogram.

* * * * *